United States Patent [19]

Venczel

[11] 3,946,578

[45] Mar. 30, 1976

[54] DETECTION OF DEFECTIVE KNITTING NEEDLES OF A KNITTING MACHINE

[76] Inventor: Joseph Venczel, 227 Eccles New Road, Salford 5, Lancashire, England

[22] Filed: Sept. 17, 1974

[21] Appl. No.: 506,894

Related U.S. Application Data

[63] Continuation-in-part of Ser. No. 505,690, Sept. 13, 1974, abandoned.

[30] Foreign Application Priority Data

Sept. 18, 1973 United Kingdom ..... 43704/73
Feb. 9, 1974 United Kingdom ..... 6002/74

[52] U.S. Cl. ..... 66/157; 250/224
[51] Int. Cl.[2] ..... D04B 15/08
[58] Field of Search ..... 66/157, 165, 111; 250/562, 250/572, 578, 206, 208, 223, 224; 356/237

[56] References Cited

UNITED STATES PATENTS

| | | | |
|---|---|---|---|
| 3,529,445 | 9/1970 | Brose | 66/165 X |
| 3,577,750 | 5/1971 | Venczel | 66/157 |
| 3,646,342 | 2/1972 | Anthony | 66/157 |
| 3,659,437 | 5/1972 | McArthur et al. | 66/157 |

OTHER PUBLICATIONS

Brose, "Fault Detection on Circular Knitting Machines", Hosiery Trade Journal, Vol. 76, No. 906, June 1969, (pp. 89–92).

Schwade, "Photoelektrische Warenkontrollean Doppelzylindr Automaten, Wirkerei-und Strickerei-Technik," Oct. 1964, Nr. 10, pp. 478–481.

*Primary Examiner*—Ronald Feldbaum
*Attorney, Agent, or Firm*—Mason, Fenwick & Lawrence

[57] ABSTRACT

A method and apparatus for detecting defective knitting needles in a circular knitting machine wherein the knitting needles are advanced along a circular path between a light source and upper and lower vertically spaced photoelectric detector devices. The direction of the light beams from the source to the two photoelectric devices is inclined at an angle to the tangent of the circular path at the beam intercept with the circular path, such that the advancing needles pass successively through the beams and a shadow of the hook end of each needle is cast on the upper photoelectric device before any shadow of any other part of the needle is cast on the lower photoelectric device, when a nondefective intact needle enters the beams. Needles with broken off hooks or closed needle latches cause a shadow to be cast on the lower photoelectric device before any shadow reaches the upper photoelectric device to activate an alarm and/or stop the knitting machine. A third photoelectric device may be positioned to receive a shadow of a different needle from the one being inspected by the upper and lower photoelectric devices to detect needles broken off too low to cast a shadow on the lower photoelectric device.

18 Claims, 23 Drawing Figures

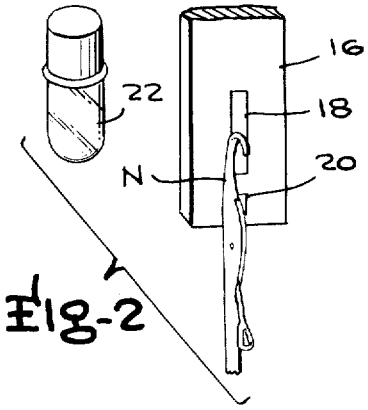
Fig-2
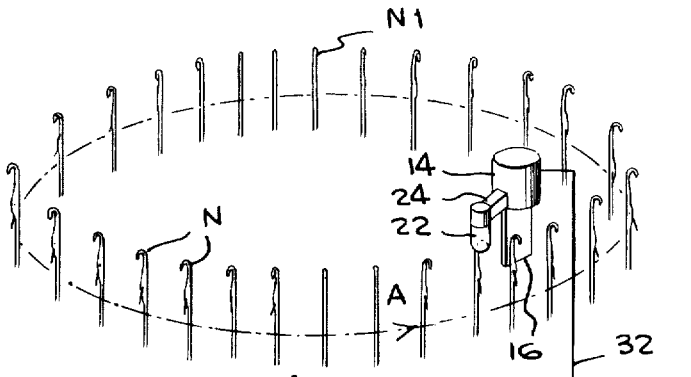
Fig-1
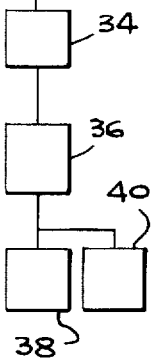
Fig-3
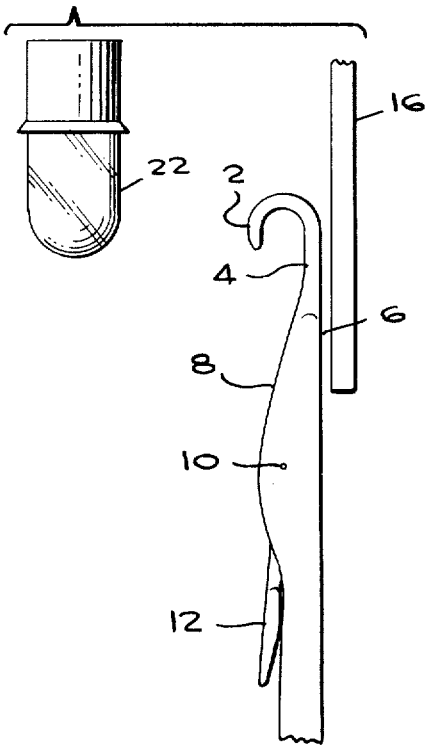
Fig-4
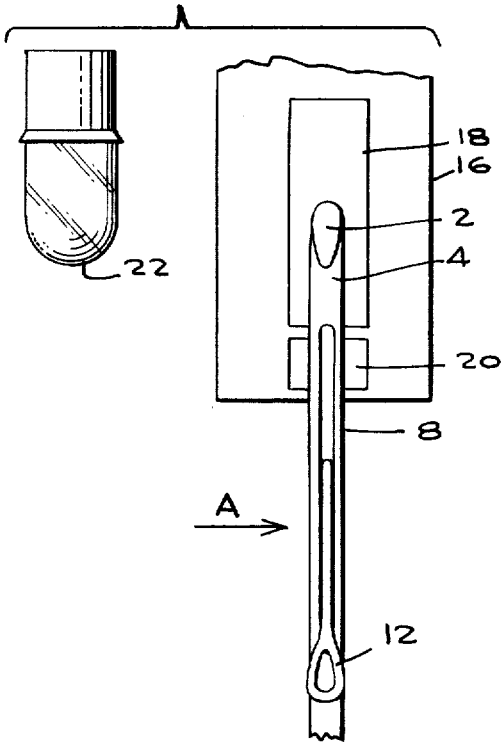
Fig-5
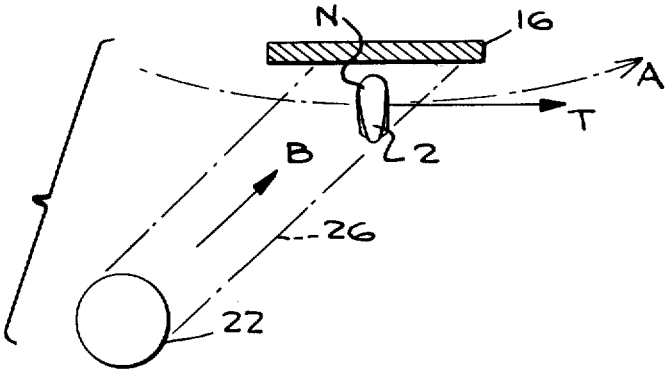

DETECTION OF DEFECTIVE KNITTING NEEDLES OF A KNITTING MACHINE

PRIOR RELATED APPLICATIONS

This application is a continuation-in-part of my prior application Ser. No. 505,690, filed Sept. 13, 1974 now abandoned claiming priority based on my prior British Pat. applications No. 43704/73 filed 18 Sept. 1973 and No. 6002/74 filed 9 Feb. 1974.

BACKGROUND AND OBJECTS OF THE INVENTION

The present invention relates to methods and apparatus for detecting defective knitting needles in a circular knitting machine in which each hooked needle in a revolving circular array is reciprocated in succession during knitting, so that the hooked end is moved a distance into an outstanding or upstanding position relative to the other hooked ends and then returned to substantially the same plane in which the other hooked ends are disposed when not being reciprocated.

Some defects such as a very slightly bent needle do not cause difficulties during knitting, but other defects such as the snapping off of a needle hook or the jamming of a needle latch in its hook-closing position are unacceptable since they cause the production of malformed fabric with a ladder fault knitting therein.

According to one aspect of the invention a method of detecting a defective knitting needle in a circular knitting machine comprises directing a beam of light across the path of travel of the knitting needles onto photoelectric means such that a hook at one end of an intact or proper needle, whose latch is open, enters the beam to cast a shadow on the photoelectric means not latter in time than any other part of the needle entering the beam casts its shadow on said photoelectric means, and detecting from an output of the photoelectric means when the shadow cast by the said end occurs later in time than that of said other part or parts to indicate a defect.

According to a second aspect of the invention there is provided a circular knitting machine comprising a circular array of knitting needles rotatable in a circular path, a first photoelectric means disposed at a higher vertical position than a second photoelectric means, a light source arranged to direct a beam of light onto said photoelectric means, an arc of said circular path passing between the light source and the photoelectric means such that when the needles are rotated along the needle path, each passes in succession through the beam and casts a shadow of the end of the needle having the hook onto the first photoelectric means and also casts a shadow of the thinner part of the shank of the needle or a jammed closed needle latch onto the second photoelectric means. The beam is directed so that when a proper needle with an intact hook and open latch enters the beam, the shadow of the hook is cast on the first photoelectric means before the shadow of any other part of the needle is cast on the second photoelectric means. However, if the hook is broken off a shadow of the shank is cast onto the second photoelectric means before any shadow of the needle is cast onto the first photoelectric means, of if the latch is jammed closed a shadow of the latch is cast onto the second photoelectric means before any shadow of the needle is cast onto the first photoelectric means. The photoelectric means is connected to control means wherein first and second electric signals are provided corresponding to shadows cast onto the first and second photoelectric means respectively when the machine is in use, and the control means is arranged to initiate stopping of the machine and/or operation of warning means, whenever a signal from the second photoelectric means for a given needle appears or occurs before the signal from the first photoelectric means for shadows cast by that same needle.

It has been found that the method of detecting defective knitting needles according to the first aspect of the invention or the use of apparatus according to the second aspect of the invention to detect defective knitting needles may fail to detect a faulty needle in certain unusual cases where a needle is snapped off so low down its shank that the photoelectric means may not have a shadow of this badly broken needle cast thereon. This is because the stump of the shank is too low and does not interrupt the light beam, and therefore no signal is issued to indicate this defect condition.

To remedy this there is provided according to a third aspect of the invention a method of detecting a defective knitting needle in a circular knitting machine comprising directing onto photoelectric means a beam of light which is interrupted by knitting needles travelling in a circular path and successively entering the beam, the photoelectric means comprising first photoelectric means disposed above second photoelectric means, and third photoelectric means offset in a horizontal direction from the first and second photoelectric means, arranging the first photoelectric means for the shadow of an intact hooked end of a first needle to be cast thereon before a shadow of the shank or a closed latch portion of the first needle is cast on the second photoelectric means, but also arraying the first and second photoelectric means for the shadow of the first needle, should it have a broken hook or a latch jammed in the closed or substantially closed position, to be first cast on the second photoelectric means, and arranging the third photoelectric means for a shadow of a second knitting needle to be cast thereon after the hooked end of the first needle has cast a shadow on the first photoelectric means. Variations in electrical outputs from the first, second and third photoelectric means due to needle shadows cast thereon are detected, said outputs are fed to control means responsive in the absence of an electrical cancel signal to the variation in output from the second and third photoelectric means to cause halting of the knitting machine and/or operation of alarm means, and the operation of the control means to prevent halting of the machine and/or operation of the alarm means is inhibited by feeding to the control means the cancel signal generated upon the appearance of the variation in output from the first photoelectric means. The cancel signal is of a predetermined duration of sufficient length for the output variation from the second and third photoelectric means to appear and disappear within the duration of the cancel signal.

According to a fourth aspect of the invention there is provided a knitting machine according to the second aspect comprising third photoelectric means offset along the needle paths from the first and second photoelectric means and arranged for the light source to illuminate the third photoelectric means such that after a first needle having an intact hook and open latch has cast a shadow onto the first and second photoelectric means a second needle passing through the beam casts a shadow onto the third photoelectric means, the third photoelectric means being connected to the control means wherein a third signal is provided corresponding to the shadow cast onto the third photoelectric means. The arrangement is such that the first signal has a duration which is longer than the time between the appearance of the second signal and the disappearance of the third signal, but if no first signal is produced because a needle is broken too low down to interrupt the beam and the next needle then interrupts the beam to cast a shadow on the third photoelectric means the corresponding third signal appears and in the absence of the first signal the control means initiates stopping of the machine and/or operation of warning means.

Each aspect of the invention will now be further described by way of example with reference to the accompanying drawings.

BRIEF DESCRIPTION OF THE FIGURES

FIG. 1 is a fragmentary and diagrammatic view of a circular knitting machine formed according to either the second or fourth aspects of the invention for carrying out the method according to the first or third aspects.

FIG. 2 is a fragmentary, diagrammatic perspective view on an enlarged scale of a knitting needle and a lamp and photoelectric devices in the machine of FIG. 1 constructed in accordance with the second aspect of the invention for carrying out the first aspect.

FIG. 3 is a side elevation to enlarged scale, of the arrangement shown in FIG. 2.

FIG. 4 is a front elevation of the arrangement in FIG. 3.

FIG. 5 is a view from above, partly in cross section, of the arrangement in FIG. 3.

DETAILED DESCRIPTION OF PREFERRED EMBODIMENTS

Figure 6:
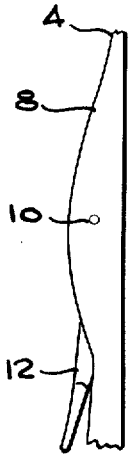
FIG. 6 is a side elevation of the knitting needle in FIG. 3 which has its hook broken off.

Referring to FIG. 1, a circular knitting machine of known construction has a plurality of upright knitting needles N disposed in a circular array and driven around a circular path indicated by arrow A. During this rotation or circular movement, the needles are moved by cams in known fashion to carry out normal known knitting action utilizing textile yarn (not shown) in the course of which each needle is vertically reciprocated in succession into an outstanding or raised position such as indicated by needle N1, by interaction of butts (not shown) of the needles with cams (not shown) on the knitting machine. At its upper end, each needle has a hook 2 facing radially outwardly of the circle or circular path. With particular reference to FIG. 3, the hook portion is joined to a neck 4 forming part of a needle shank 6 provided with cheeks 8 in which is pivotably mounted at 10 a latch 12 which can be pivoted from a hook closing position into the depending attitude in FIG. 3 to fully open the hook.

A housing 14 is mounted on the knitting machine by means (not shown) above the needles. A limb or depending housing leg 16 located inside the circle of needles depends from the housing. Photoelectric devices 18 and 20, for example photovoltaic elements are mounted on the limb or leg 16. Exposure windows or light sensitive surfaces of the photoelectric devices can be located in a common plane which may be vertical, and they face outwardly of the circle of needles. These light sensitive surfaces or exposure windows can be substantially flush with a surface of the limb or leg 16. As shown in FIG. 2 for example the light sensitive surface or exposure window of the device 18 is located at a higher vertical level than that of the device 20. An electric lamp 22 located outside the circle of needles is mounted on a bridging member extending over the needles and mounted or connected to the housing 14.

As can be seen with reference to FIGS. 4 and 5, the lamp 22 is offset from the photoelectric devices 18 and 20 in an opposite direction to the direction in which a needle is moving along the circular needle path when the latter passes the lamp and photoelectric devices.

The lamp 22 emits a continuous beam of light 26 in the direction of arrow B in FIG. 5, onto the photoelectric devices to wholly illuminate the latter when no obstruction is interposed between the lamp and the photoelectric devices. This beam can be relatively narrow. The height of the lamp and photoelectric devices is such that as the needles are rotated, or moved along the curved needle path, each in success passes through the beam and casts a shadow on the photoelectric devices. From FIG. 5 it will be understood the direction B of the light directed onto the photoelectric devices has a component of direction which is in the same direction as that of a tangent T to the circular path A, along which tangent the needle is moving at the place where the beam intersects the circular path.

Figure 7:
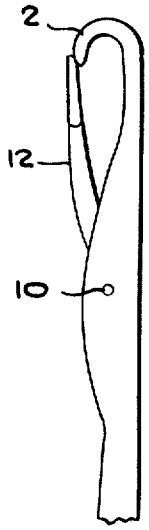
FIG. 7 is a side elevation of the knitting needle in FIG. 3, with its latch jammed in the closed position.
Figure 8:
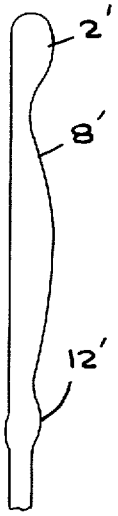
FIG. 8 is the silhouette of the needle in FIG. 3, with its hook intact and latch open when viewed from the lamp in FIGS. 3, 4 and 5 along the path of the light shown in FIG. 5.
Figure 9:
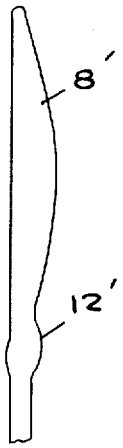
FIG. 9 is the silhouette of the broken needle in FIG. 6 when it is in the same position as the needle in FIGS. 3, 4 and 5.
Figure 10:
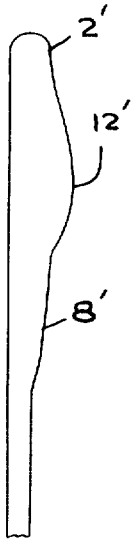
FIG. 10 is the silhouette of the needle with the jammed latch in FIG. 7, when in the same position as the needle in FIGS. 3, 4 and 5.
Figure 11:
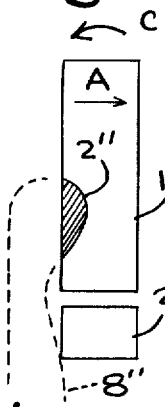
FIGS. 11 and 12 show a front view of light sensitive surfaces or windows the the photoelectric devices of FIG. 4 with other components absent and illustrate the shape of the shadow of the needle having the silhouette in FIG. 8, which is cast on an imaginary vertical plane in which the light sensitive surfaces are located, and also illustrate the progress of the shadow across the plane as the needle moves through the beam of light directed from the lamp onto the photoelectric devices in the arrangement illustrated in FIGS. 3, 4 an 5.
Figure 12:
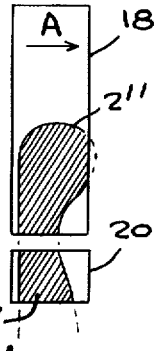

When a moving needle following the circular path A is located between the limb 16 and the lamp 22 and is viewed along the general direction of arrow B by an observer at the lamps, such an observer would see a partial front view and a partial side view of the needle. To such an observer, a needle with its hook intact and its latch fully open would have a silhouette as shown in FIG. 8 in which 2' is the silhouette of the hook, 8' the silhouette of the shank cheeks and 12' the silhouette of the latch. If the hook of the needle were broken off as shown in FIG. 6 the observed silhouette of the broken needle would be as shown in FIG. 9, and if the latch 12 were jammed closed as shown in FIG. 7, or nearly so, the silhouette would be as shown in FIG. 10. Therefore, when a needle with its hook intact and its latch open, enters the beam 26, the shadow cast on the photoelectric devices is comparable with the shape of the silhouette in FIG. 8. Because the needle is moving in the direction of arrow A (FIG. 5), the hook of the needle enters the light beam first, followed by other parts of the needle. The photoelectric device 18 is arranged for the shadow of the hook 2 and neck 4 of the needle to be cast thereon, while the lower photoelectric device 20 is arranged for shadow of the upper part of the shank cheek 8 to be cast thereon. Thus it will be seen from FIG. 11 that as the needle moves across the beam of light, a shadow 2'' of the hook 2 moving in the direction A precedes a shadow 8'' of the cheeks 8 and is cast on the upper photoelectric device 18 before the shadow of any other part of te needle is cast on the lower photoelectric device 20. FIG. 12 shows that as the needle continues to move in direction A, the shadow cast by the needle moves across both photoelectric devices 18 and 20. Ultimately the shadow moves off both photoelectric devices which then receive full illumination until the next needle enters the beam.

Figure 13:
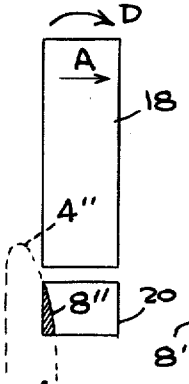
FIGS. 13 and 14 are similar to FIGS. 11 and 12 but illustrate the shape and progress of the shadow of a broken needle having the silhouette shown in FIG. 9.
Figure 14:
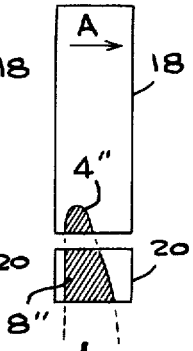

The shadow cast by a needle with a broken hook is of a shape comparable with that of the silhouette in FIG. 9. In this case as shown in FIG. 13, the shadow 8'' of the cheeks precedes a shadow 4'' of the broken neck. Consequently the shadow 8'' is cast on the photoelectric device 20 before any shadow is cast on the photoelectric device 18. Continued movement of the needle causes the shadow to be cast on both photoelectric devices as shown in FIG. 14.

Figure 15:
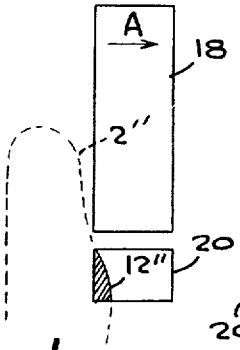
FIGS. 15 and 16 are similar to FIGS. 11 and 12 but illustrate the shape and progress of a needle with a jammed latch having the silhouette shown in FIG. 10.
Figure 16:
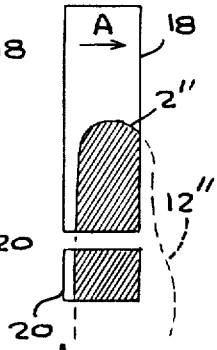

The shadow cast by a needle whose latch is jammed closed is of a shape comparable with that of the silhouette in FIG. 10. Because of this, as shown in FIG. 15, a shadow 12'' of the latch 12 precedes the shadow 2'' of the hook and is cast on the photoelectric device 20 before the shadow 2'' of the hook is cast on the photoelectric device 18. Continued movement of shadow causes it to be cast on both photoelectric devices 18 and 20 as shown in FIG. 16.

Figure 17:
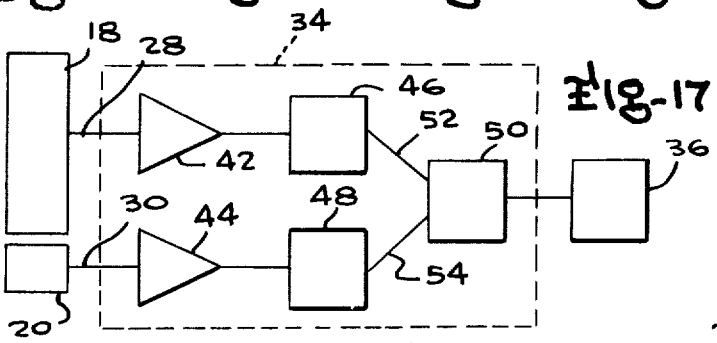
FIG. 17 is a diagrammatic representation of an electronic control circuit used in the machine formed according to the second aspect of the invention, and for carrying out the method according to the first aspect.

Referring to FIG. 17, the photoelectric devices 18 and 20 are connected to electrical conducting paths 28 and 30 comprising cable 32 in FIG. 1. These paths lead to a control circuit 34 connected to a relay 36 which in FIG. 1 is shown connected to a knitting machine stop motion 38 and/or an alarm device 40 to give visual and/or audible warning of detection of a faulty knitting needle. The control circuit comprises amplifiers 42 and 44 wave shapers 46 and 48 and a gate device 50. The gate device is open unless closed by a signal on input line 52 (which can be conveniently called a cancel signal). If the gate should receive a signal on the input line 54 (which can be conveniently referred to as a stop signal) when no cancel signal is present on input 52, to gate device 50, the gate device provides an output pulse to actuate the relay 36. The control circuit is arranged so that when an intact needle with an open latch passes through the light beam, the cancel signal on line 52 holds the gate device 50 closed for the duration of the stop signal and no output pulse is provided by the gate device. But when a defective needle passes through the beam, the stop signal on input 54 appears first at the open gate device 50 which then provides the output pulse to actuate the relay.

Figure 20:
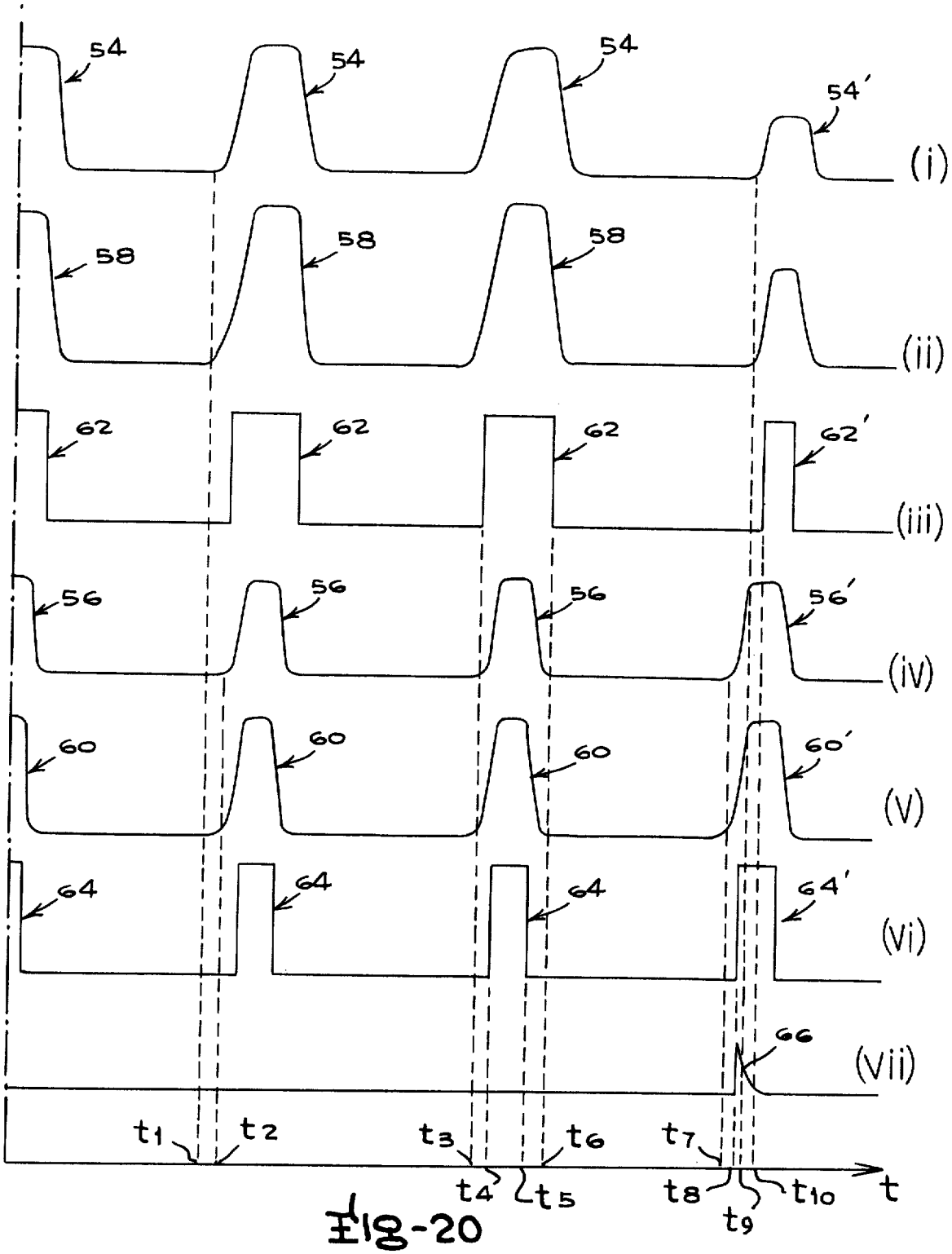
FIG. 20 shows diagrammatic representations of electrical signals produced with respect to time in different parts of the control circuit in FIG. 17 when a needle with broken hook is detected.

Referring to FIG. 20, the electrical signal output from photoelectric device 18 is shown at FIG. 20(i), this signal when amplified by amplifier 42 (FIG. 17) is shown at FIG. 20(ii), and the corresponding square wave output from wave shaper 46 (FIG. 17) is shown at FIG. 20(iii). FIG.20(iv) shows the output signal from photoelectric device 20, FIG. 20(v) shows the signal when amplified by amplifier 44 (FIG. 17), and the corresponding square wave from the wave shaper 48 (FIG. 17) is shown at FIG. 20(vi). An output pulse provided by the gate device 50 is shown at FIG. 20(vii). These signals are represented with respect to a common time axis t.

When each of a number of successive needles with an intact hook and an open latch enters the light beam and casts its shadow on the photoelectric devices 18 and 20 the variator in electrical signal outputs therefrom are represented by waves 54 and 56 in FIGS. 20(i) and 20(iv). These waves or pulses 54, 56 may conveniently be called shadow signals. Because the hook casts its shadow on the photoelectric device 18 before the shadow of any other part of the needle is cast on the photoelectric device 20, the shadow signal or pulse 54 starts to appear at a time $t1$ before the corresponding shadow signal 56 which appears at time $t2$. These shadow signals are amplified by two respective amplifiers 42 and 44 whose outputs give amplified shadow signal 58 and 60 shown in FIGS. 20(ii) and 20(v). The wave shapers 46 and 48 (FIG. 17) convert the amplified shadow signals into respective square waves 62 and 64 shown in FIGS. 20(iii) and (vi). The square waves 62 of predetermined duration are the cancel signals and the square waves 64 of shorter predetermined duration are stop signals. The arrangement of the apparatus is such that because the shadow signal 54 starts to appear before the corresponding shadow signal 56, the leading edge of cancel signal 62 corresponds to the shadow signals 54 and appears at a time $t3$ (for example) in advance of the appearance at a time $t4$ of the leading edge of the stop signal 64. The cancel signal 62 derived from the output of device 18 is fed to the gate device 50 on line 52 and is holding the latter closed when the stop signal 64 arrives at the gate. The apparatus is also arranged to ensure that the cancel signal 62 terminates at a time *t*6 after the termination of the stop signal 64 at a time *t*5. Therefore the gate device 50 is held closed for the duration of the stop signal 64, and provides no output pulse. Consequently relay 36 is not actuated and the knitting machine continues to run normally since the stop motion has not been operated.

When a needle with a broken hook moves into the beam, the shadow cast on the photoelectric devices 18 and 20 is as described with reference to FIGS. 13 and 14 with the shadow of the shank cheeks 8'' being cast on the photoelectric device 20 before any shadow is cast on the device 18. The output from the device 20 is represented by the shadow signal 56' (FIG. 20(iv)) which is the same as any other shadow signal 56. However the output from the device 18 is represented by the shadow signal 54' (FIG. 20(i)) which is of reduced amplitude compared with the other shadow signals 54. The shadow signal 56' starts to appear at a time *t*7 in advance of the time *t*9 at which the shadow signal 54' appears. The leading edge of square wave stop signal 64' (FIG. 20(vi)) produced by shaper 48, and corresponding to shadow signal 56', appears at time *t*8 in advance of tiem *t*10 at which the leading edge of square wave cancel signal 64' corresponding to shadow signal 54' appears. Therefore the stop signal 64' is fed to gate device 50 before the cancel signal 62' and the gate device provides an output pulse 66 which actuates the relay 36 to operate the stop motion 38 and the alarm means 40 (FIG. 1) whereby the machine is stopped and warning of the defective needle given. The gate device closes upon receiving the cancel signal 64' but the machine stops under the effect of the stop motion to enable the defective needle to be replaced.

Figure 21:
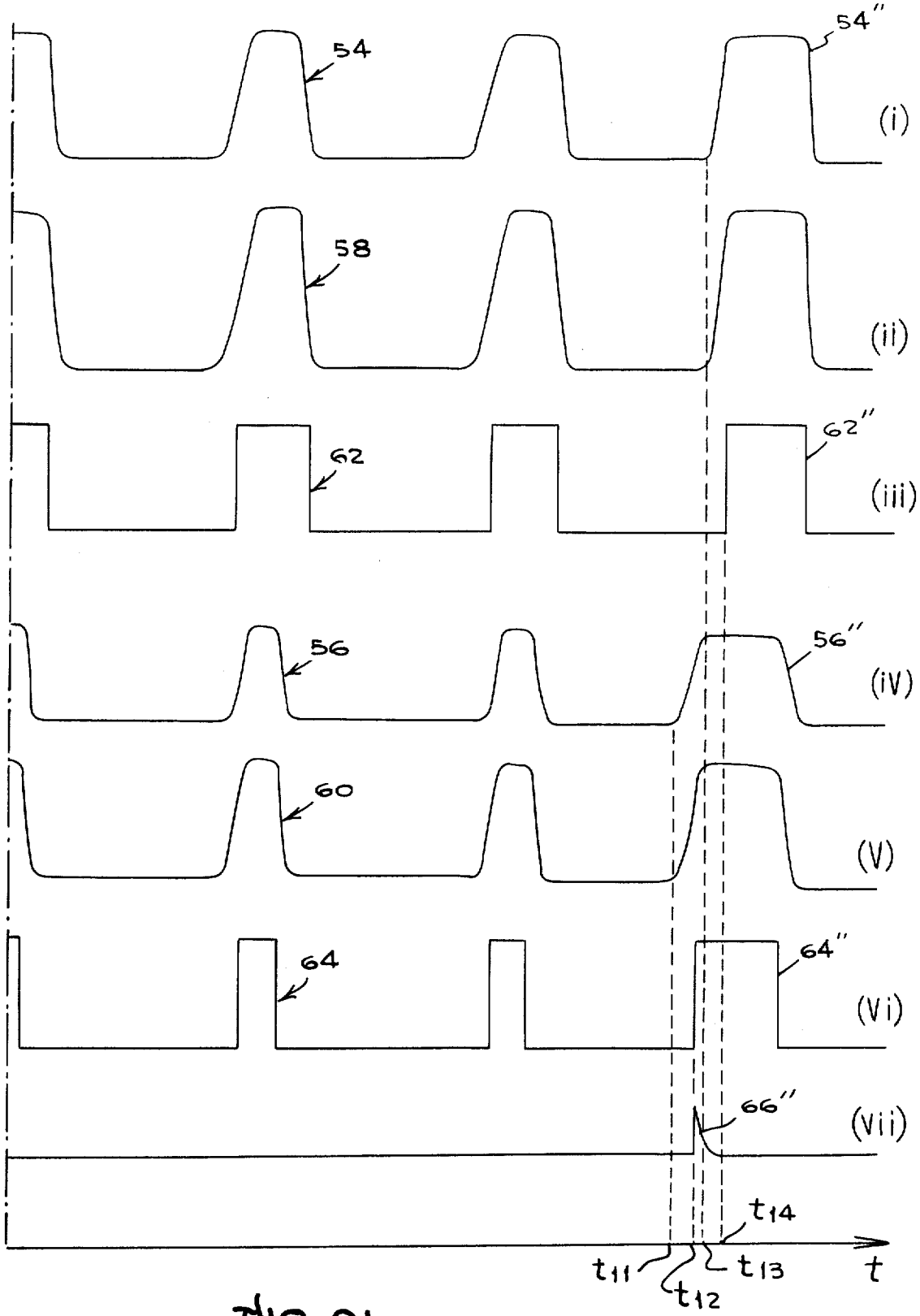
FIG. 21 shows diagrammatic representations of electrical signals produced with respect to time in different parts of the control circuit in FIG. 17 when a needle with a jammed latch is detected.

In FIG. 21, like references refer to like signals and times described with reference to FIG. 20.

When a needle with a closed latch enters the light beam as described with reference to FIGS. 15 and 16, the shadow 12'' of the latch is cast on the photoelectric device 20 before any shadow on the photoelectric device 18. Therefore shadow signal 56'' starts to appear at time *t*11 in advance of shadow signal 54'' which starts to appear at time *t*13. The leading edge of stop signal 64'', corresponding to shadow signal 56'', starts to appear at time *t*12 in advance of time *t*14 at which the leading edge of cancel signal 62'', corresponding to shadow signal 54'', appears. The gate device receives the stop signal 64'' first and provides an output pulse 66''. Therefore the stop motion and alarm means actuate.

It will be appreciated from the foregoing that when a needle with an intact hook and satisfactorily opened latch passes through the light beam, the cancel signal must occur before the stop signal and have a sufficiently long duration to terminate after the stop signal. There are various ways of ensuring this. For example, the wave shapers 46 and 48 may incorporate Zenner diode devices arranged so that the Zenner diode device associated with wave shaper 46 goes into conduction at an input shadow signal value thereto lower than that at which the Zenner diode device in wave shaper 48 goes into condution, and the wave shaper 46 cuts off its output signal when the input shadow signal falls to a lower value than the value of the input shadow signal at which wave shaper 48 cuts its output signal off. In addition, or as an alternative, amplifier 42 may have a higher gain than amplifier 44 so that the input to wave shaper 46 is always stronger than the input to wave shaper 48 at anytime when a non-defective needle is passing through the beam, to ensure the cancel signal occurs before the stop signal.

The position of the lamp 22 and housing limb 16 are adjustable relative to one another to facilitate the setting up of the apparatus. Furthermore, the housing limb may be tilted, in a vertical plane, in the direction of arrow C in FIG. 11, about a horizontal axis to ensure the shadow 2'' of the hook is cast on the photoelectric device 18 even sooner, relative to the casting of the shadow 8'' of the shank on the photoelectric device 20 than with the step-up shown in FIG. 11. A similar effect could be achieved by offsetting the position of the photoelectric device 18 in FIG. 11 to the left in the figure relative to photoelectric device 20, or offsetting the latter to the right relatively to the device 18. This ensures an earlier response to a diffective needle then with the set-up in FIGS. 13 to 16. The device 20 could be offset to the left in these figures relative to the device 18, or the limb could be pivoted in the direction of arrow D in FIG. 13 to produce the offsetting to the left of the device 20.

Figure 19:
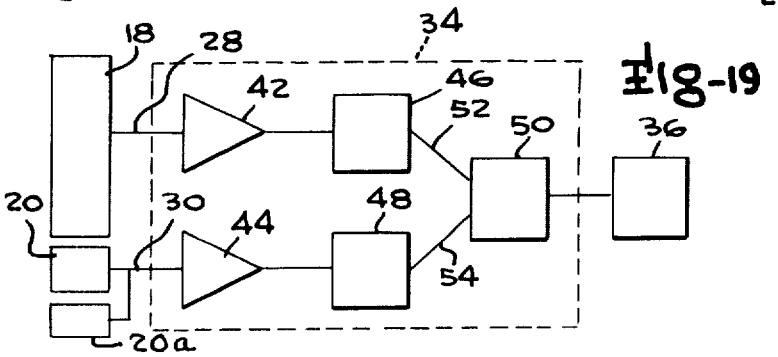
FIG. 19 is a diagrammatic representation of an electronic control circuit used on the machine formed according to the fourth aspect of the invention and for carrying out the method according to the third aspect.
Figure 18:
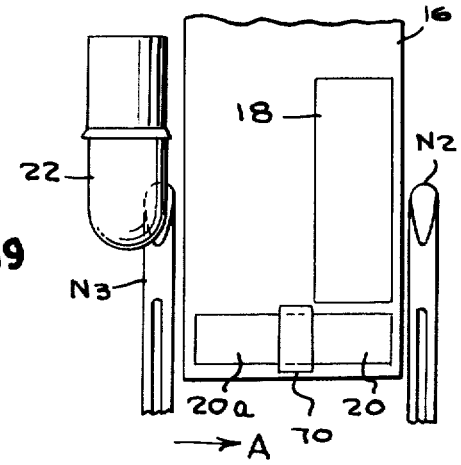
FIG. 18 is a fragmentary front elevational view of the machine in FIG. 1 formed according to the fourth aspect of the invention and for carrying out the method according to the third aspect.

Should a needle be broken so low down that the shank stump does not pass through the light beam, the detector apparatus described above will not give a response. To avoid this difficulty the apparatus may be modified as shown in FIGS. 18 and 19, in which like references refer to like parts in FIGS. 1 to 17. In FIG. 18, the housing limb 16 is provided with a further photoelectric device 20*a* at the same vertical height as the device 20 but offset horizontally from the devices 18 and 20 in the opposite direction to the direction of travel of the needles by a distance substantially equal to one-half of the distance or spacing between two adjacent needles along the needle path. Although the photoelectric device 20*a* has been described as a further device, it may preferably be another light sensitive area or exposure window of the device 20 but separated from the previously described light sensitive area or window of the device 20 by an opaque mask 70. The arrangement is such that the beam of light from lamp 22 is directed onto all the photoelectric devices. After a needle N2 passing through the beam has cast its shadow on the devices 18 and 20 and has moved sufficiently for its shadow to be cast no longer on these devices, the next needle N3 to enter the beam, first casts a shadow on the device 20*a* and then moves to cast its shadow on the devices 18 and 20 and so on for successive needles. The devices 20 and 20*a* are both connected to like conducting path 30 to like control 34.

Figure 22:
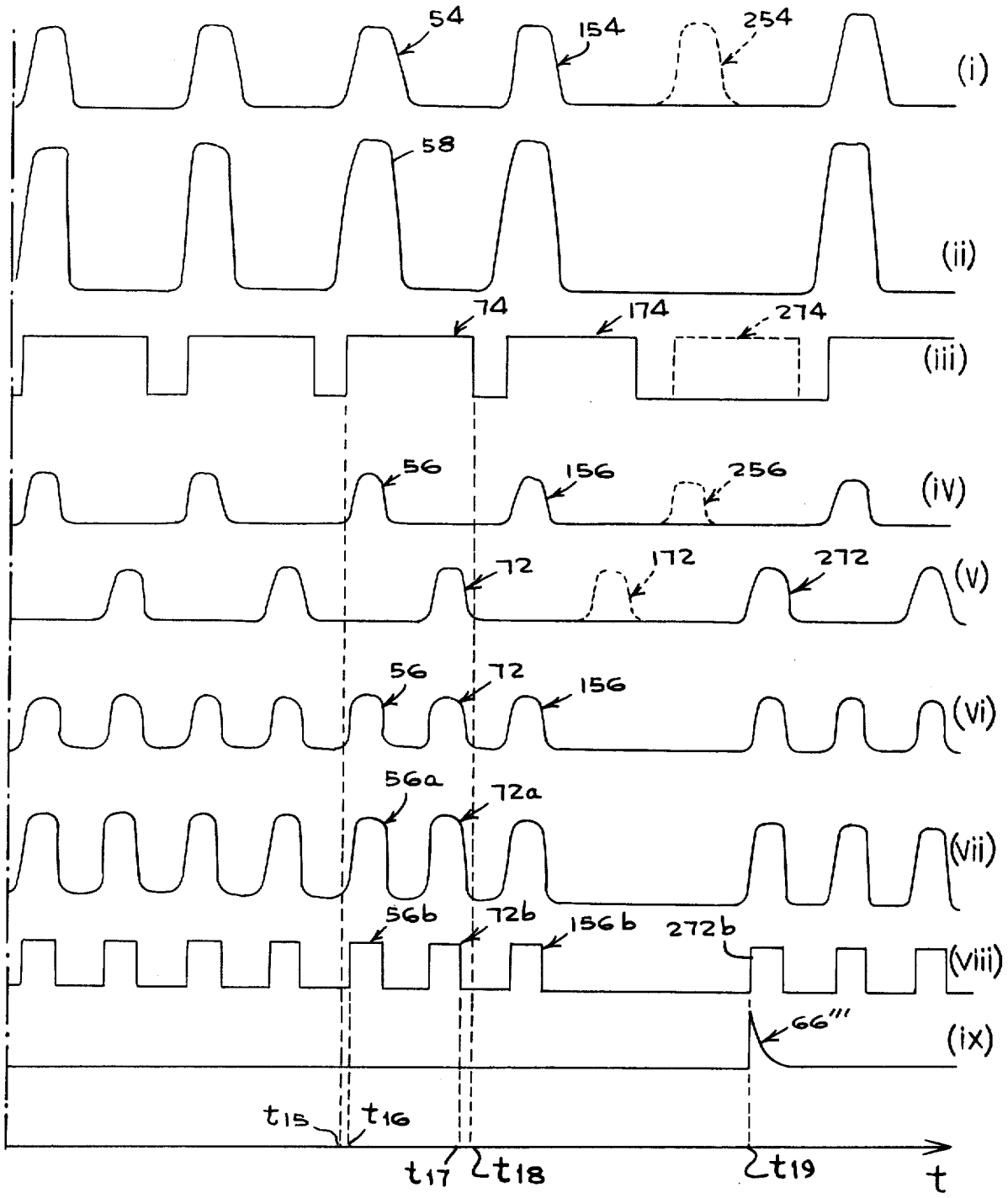
FIG. 22 shows diagrammatic representations of electrical signals produced with respect to time in different parts of the control circuit in FIG. 19, when the needle is broken off low down the shank.
Figure 23:
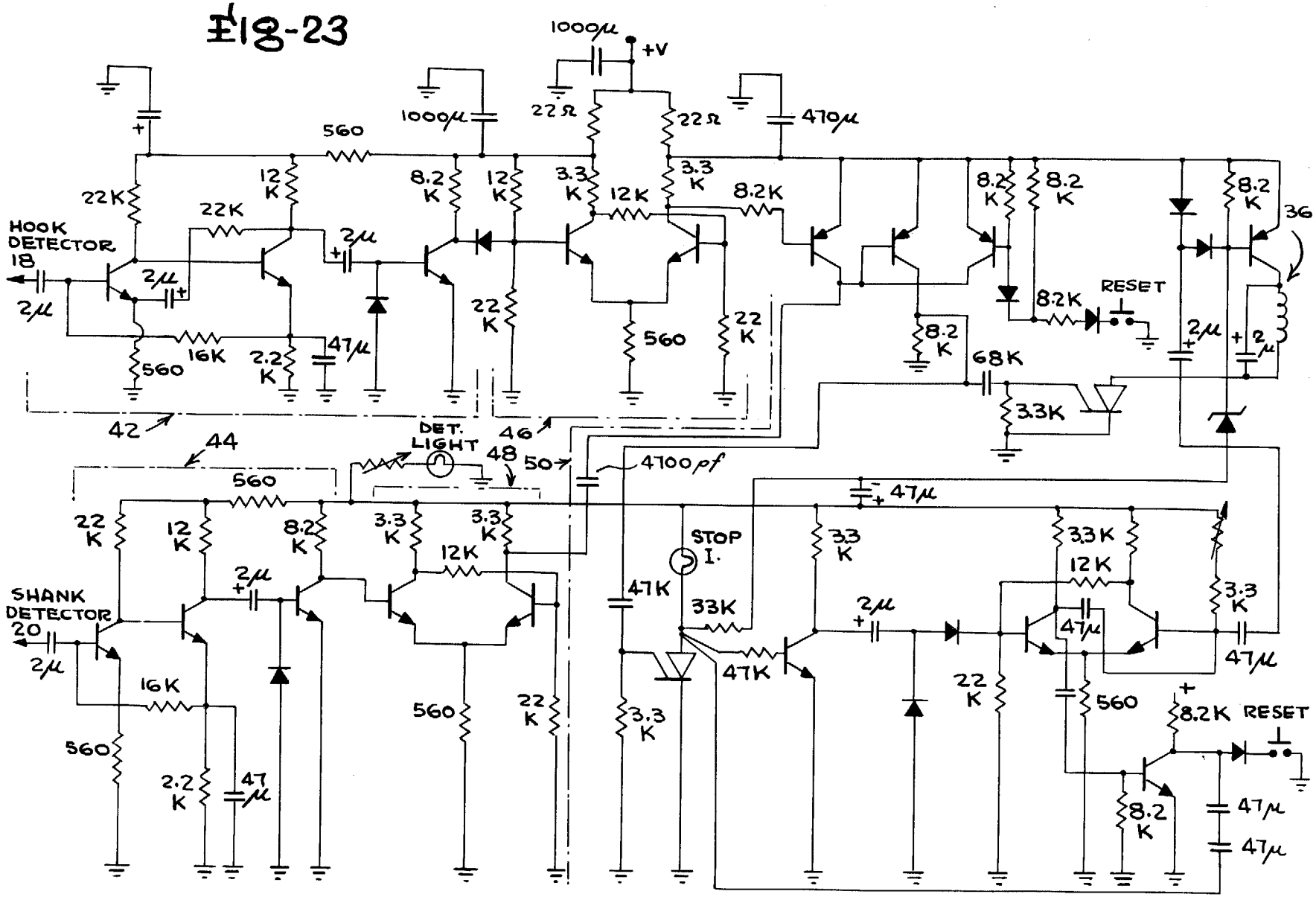
FIG. 23 is a schematic circuit diagram of an example of electronic circuitry which may be used for the amplifier, pulse shaper and gate circuits of the control means in the present invention.

Referring to FIG. 22, the shadow signal output from the photoelectric device 18 is shown at FIG. 22(i), this signal when amplified by amplifier 42 is shown at FIG. 22(ii), and the corresponding square wave output from wave shaper 46 is shown at FIG. 20(iii). The shadow signal output from the photoelectric device 20 is shown at FIG. 20(iv), the shadow signal output from the photoelectric device 20*a* is shown at FIG. 20(v), the combination of these two shadow signals which is fed to amplifier 44 is shown at FIG. 22(vi), the amplified output from amplifier 44 is shown at FIG. 22(vii), and the corresponding square wave output from the wave shaper 48 is shown at FIG. 22(viii). An output pulse provided by the gate device is shown at FIG. 22(ix). These signals are represented with respect to the common time axis *t*.

When an intact first needle with its latch open passes through the beam, and after casting its shadow on the device 20*a*, the hook of the needle first casts a shadow on the upper photoelectric device 18 so that a shadow signal 54 (FIG. 22(i)) starts to appear before the corresponding shadow signal 56 (FIG. 22(iv)) from the lower photoelectric device 20. Shadow signal 54 is amplified, as shown at 58 (FIG. 22(ii)), by the amplifier 42. After the shadow signal 56 has appeared and disappeared, the next or second needle which is not broken (or not broken so low down its shank that it misses the beam) enters the beam and casts a shadow on the device 20*a* which produces the shadow signal 72 (FIG. 22(v)). Shadow signals 56 and 72 are added together as shown in FIG. 20(vi). These combined shadow signals are amplified as shown at 56*a* and 72*a* by the amplifier 44. The square wave stop signals from wave shaper 48 corresponding to shadow signals 56*a* and 72*a* are shown at 56*b* and 72*b*. From wave shaper 46, a square wave cancel signal output of predetermined duration, corresponding to shadow signal 54 is shown at 74 in FIG. 22(iii). Because shadow signal 54 appeared before shadow signal 56, thhe leading edge of cancel signal 74 appeared at time *t*15 in advance of the leading edge of stop signal 56*b* which appears at time *t*16. As the speed of rotation of the needles is known it is comparatively easy by employing a capacitance-resistor technique in wave shaper 46 to extend the duration of the cancel signal 74 so that it disappears at time *t*18 a short period after the time *t*17 at which stop signal 72*b* disappears. Consequently gate device 50 is held closed by the cancel signals on line 52 while the cancel signals 56*b* and 72*b* appear and disappear on line 54. Therefore the stop motion is not actuated. This second needle then moves sufficiently for its hook to cast a shadow on the device 18 and thereafter its shank casts a shadow on the device 20 producing shadow signals identical with previous shadow signals 54 and 56 but identified at 154 and 156 respectively in FIGS. 22(i) and 22(iv), so that a cancel signal 174 is initiated similar to cancel signal 74. If the next or third needle is so badly broken that it misses the beam a shadow signal 172 is not produced, but the gate 50 remains closed by virtue of the cancel signal 174 which appears before the stop signal 156*b* and terminates thereafter. Therefore the stop motion is not actuated. Now the broken third needle moves to a position where, if it were whole and operating perfectly, it would have cast a shadow on the devices 18 and 20 to produce shadow signals 254 and 256 which are missing. Since no shadow is cast by this badly broken needle onto the photoelectric device 18, no cancel signal 274 is generated by wave shaper 46 so that the gate device 50 remains open. Now when the succeeding or fourth needle enters the beam, it casts a shadow on photoelectric device 20*a* which produces shadow signal 272 (FIG. 22(v)). In response wave shaper 48 produces the stop signal 272*b* at time *t*19. This stop signal is supplied to the open gate device 50 which produces an output pulse 66''' to actuate the relay 36 thereby initiating operation of the stop motion.

In other respects the apparatus operates in the same manner as that described with reference to FIGS. 1 to 17 inasmuch as when only the hook of a needle is snapped off or the needle latch is jammed closed, the shadow of such a needle is cast on the device 20 first before a shadow is cast on the device 18 and thus the stop signal appears before the cancel signal to initiate halting of the machine.

If the needles are very fine and mounted very close together the photoelectric device 20*a* may be spaced from the devices 18 and 20 by a distance substantially equal to three, five or any other odd whole number of times half the distance between adjacent needles. This is to prevent a needle casting its shadow simultaneously on the photoelectric devices 20 and 20*a*.

What I claim is:

1. A needle detector for a circular knitting machine comprising a circular array of knitting needles advancing along a circular path, comprising first and second photoelectric means, said first photoelectric means being disposed at a higher vertical position than said second photoelectric means, a light source arranged to direct a beam of light onto both said photoelectric means, an arc of said circular path passing between the light source and the photoelectric means such that when the needles are advanced along said path each passes in succession through the beam and casts a shadow of the end of the needle having the hook onto the first photoelectric means and casts the shadow of at least part of the shank of the needle or a jammed closed needle latch on the second photoelectric means, the beam being directed so that when a needle with an intact hook and open latch enters the beam, the shadow of the hook is cast on the first photoelectric means before the shadow of any other part of the needle is cast on the second photoelectric means and if the hook is broken off a shadow of the shank is cast on the second photoelectric means before any shadow of the needle is cast on the first photoelectric means, and the direction of said beam being such that if the latch is jammed closed a shadow of the latch is cast on the second photoelectric means before any shadow of the needle is cast on the first photoelectric means, control means connected to said photoelectric means whereby first and second electric signals are supplied by said photoelectric means to said control means corresponding to shadows cast on the first and second photoelectric means respectively when the machine is in use, and said control means including means to initiate stopping of the machine and/or operation of warning means, when for a said needle passing through the beam, a said second signal appears before a said first signal.

2. A needle detector machine as claimed in claim 1, in which said control means includes a gate device arranged for said first and second signals to be supplied to first and second inputs respectively of said gate device, said gate device being arranged to be closed by a said first signal supplied thereto and to give an output to initiate stopping of the machine and/or operation of warning means when a said second signal is supplied thereto and a said first signal is absent, and said control means including causing said first signal produced responsive to a shadow of an intact hook of a said needle to have a duration longer than the duration of the second signal produced corresponding to the shadow cast by the same needle on the second photoelectric means.

3. A needle detector machine as claimed in claim 1, wherein the first and second signals are square waves.

4. A needle detector machine as claimed in claim 2, wherein the first and second signals are square waves.

5. A method of detecting a defective knitting needle in a circular knitting machine comprising directing onto photoelectric means a beam of light which is interrupted by knitting needles travelling along a circular path successively entering the beam, said photoelectric means comprising first photoelectric means disposed above second photoelectric means and third photoelectric means offset in a horizontal direction from the first and second photoelectric means, locating said first photoelectric means for the shadow of an intact hooked end of a first needle to be cast thereon before a shadow of the first needle is cast on the second photoelectric means, and locating the first and second photoelectric means for the shadow of said first needle, should it have a broken hook or a latch jammed in the closed or substantially closed position, to be first cast on the second photoelectric means, and locating the third photoelectric means for a shadow of a second knitting needle to be cast thereon after the hooked end of the first needle has cast a shadow on the first photoelectric means, detecting variation in electrical outputs from the first, second and third photoelectric means due to needle shadows cast thereon, generating an electrical cancel signal responsive to an output from said first photoelectric means representing a needle shadow cast thereon, feeding said outputs to control means responsive, in the absence of an electrical cancel signal, to the variation in output from the second and third photoelectric means to cause halting of the knitting machine and/or operation of alarm means, and inhibiting the operation of the control means to prevent halting of the machine and/or operation of the alarm means by feeding, to said control means, said cancel signal generated upon the appearance of the variation in output from the first photoelectric means, which cancel signal is of a predetermined duration of sufficient length for the output variation from the second and third photoelectric means to appear and disappear within the duration of the cancel signal.

6. A needle detector machine according to claim 1 comprising third photoelectric means offset along the needle path from the first and second photoelectric means and located for the light source to illuminate said third photoelectric means such that after a first needle having an intact hook and open latch has cast a shadow on the first and second photoelectric means a second needle passing through the beam casts a shadow onto the third photoelectric means, said third photoelectric means being connected to the control means whereby a third signal is provided corresponding to the shadow cast on the third photoelectric means, said control means including means whereby said first signal has a duration which is longer than the time between the appearance of the second signal and the disappearance of the third signal and whereby if no first signal is produced for a said first needle because such needle is broken too low down to interrupt the beam and a said second needle then interrupts the beam to cast a shadow on the third photoelectric means, the corresponding third signal is produced to cause said control means in the absence of a said first signal to initiate stopping of the machine and/or operation of warning means.

7. A needle detector as claimed in claim 6, wherein said control means includes a gate device arranged for said first and second signals to be supplied to first and second inputs respectively of said gate device, said gate device being arranged to be closed by a said first signal supplied thereto and to give an output to initiate stopping of the machine and/or operation of warning means when a said second signal is supplied thereto and a said first signal is absent, and said control means including causing said first signal produced responsive to a shadow of an intact hook of a said needle to have a duration longer than the duration of the second signal produced corresponding to the shadow cast by the same needle on the second photoelectric means and in which the third signal is supplied to the gate device, and the gate device gives said output when the third signal is supplied thereto and the first signal is absent.

8. A needle detector as claimed in claim 6, wherein the first and second signals are square waves and in which the third signal is a square wave.

9. A needle detector as claimed in claim 7, wherein the first and second signals are square waves and in which the third signal is a square wave.

10. A needle detector as claimed in claim 6 in which the third photoelectric means is offset from the first photoelectric means by a distance substantially equal to a whole odd multiple of the distance spacing two adjacent needles.

11. A needle detector as claimed in claim 8 in which the third photoelectric means is offset from the first photoelectric means by a distance substantially equal to a whole odd multiple of the distance spacing two adjacent needles.

12. A needle detector as claimed in claim 6 in which the third and second photoelectric means comprise separate exposure windows admitting light to light sensitive areas of the same photoelectric device.

13. A needle detector as claimed in claim 7 in which the third and second photoelectric means comprise separate exposure windows admitting light to light sensitive areas of the same photoelectric device.

14. A needle detector as claimed in claim 8 in which the third and second photoelectric means comprise separate exposure windows admitting light to light sensitive areas of the same photoelectric device.

15. A method of detecting a defective latch type knitting needle in a circular knitting machine wherein the needles are disposed substantially vertically and travel along a circular path about a vertical cylinder axis, comprising directing onto a pair of vertically spaced photoelectric detectors forming upper and lower detectors a beam of light in a direction crossing the circular path of travel of the knitting needles such that a shadow of a hook end of each intact needle passing through the beam is cast on the upper photoelectric detector and a shadow of portions of the needle below the hook is cast on the lower photoelectric detector, locating the upper and lower photoelectric detectors to cause the shadow of the hook of each intact needle having a properly positioned latch to be first cast on the upper photoelectric detector before a shadow of any other part of the needle is cast on the lower photoelectric detector and to cause a shadow of a portion of any needle entering the beam which has a broken hook or a latch jammed in closed or substantially closed position to be first cast on the lower photoelectric detector before any shadow of that needle is cast on the upper photoelectric detector, advancing the knitting needles along said circular path into said beam, and detecting from outputs of the photoelectric detectors when the shadow cast by a needle on said upper photoelectric detector occurs later than the shadow of the same needle cast on said lower photoelectric detector to indicate a defect.

16. A method of detecting a defective knitting needle as defined in claim 16, wherein the direction of the light beam directed across said circular path to the two photoelectric detectors is inclined at an angle to the tangent of the circular needle path at the beam intercept with the circular path such that the advancing needles pass through the beam in such order that a shadow of the hook end of each intact needle is cast on the upper photoelectric detector before any shadow of any other part of the needle is cast on the lower photoelectric detector when a non-defective intact needle enters the beam.

17. A method of detecting defective knitting needles as defined in claim 15, wherein the detecting from the outputs of the photoelectric detectors when the upper photoelectric detector has a shadow cast thereon before the lower photoelectric detector comprises the steps of detecting variations in electrical outputs from the upper and lower photoelectric detectors due to needle shadows cast thereon, generating an electrical cancel signal responsive to an output from the upper photoelectric detector representing a needle shadow cast thereon, feeding said electrical outputs to control means responsive, in the absence of an electrical signal, to the variation in output from the lower photoelectric detector to cause halting of the knitting machine, and inhibiting the operation of the control means to prevent halting of the machine by feeding to said control means said cancel signal generated upon the appearance of the variation in electrical output from the upper photoelectric detector.

18. A method of detecting defective knitting needles as defined in claim 16, wherein the detecting from the outputs of the photoelectric detectors when the upper photoelectric detector has a shadow cast thereon before the lower photoelectric detector comprises the steps of detecting variations in electrical outputs from the upper and lower photoelectric detectors due to needle shadows cast thereon, generating an electrical cancel signal responsive to an output from the upper photoelectric detector representing a needle shadow cast thereon, feeding said electrical outputs to control means responsive, in the absence of an electrical signal, to the variation in output from the lower photoelectric detector to cause halting of the knitting machine, and inhibiting the operation of the control means to prevent halting of the machine by feeding to said control means said cancel signal generated upon the appearance of the variation in electrical output from the upper photoelectrical detector.

* * * * *